US005546861A

United States Patent [19]

Löffler

[11] Patent Number: 5,546,861

[45] Date of Patent: Aug. 20, 1996

[54] METHOD OF CONTROLLING INKING IN A PRINTING PRESS

[75] Inventor: Gerhard Löffler, Walldorf, Germany

[73] Assignee: Heidelberger Druckmaschinen AG, Heidelberg, Germany

[21] Appl. No.: 425,826

[22] Filed: Apr. 20, 1995

[30] Foreign Application Priority Data

Apr. 20, 1994 [DE] Germany ..... 44 13 731.1

[51] Int. Cl.[6] ..... B41F 31/00

[52] U.S. Cl. ..... 101/484; 101/487

[58] Field of Search ..... 101/147, 148, 101/487, DiG. 45, 350, 484, 485, 207–210, 366, 364

[56] References Cited

U.S. PATENT DOCUMENTS

| | | | |
|---|---|---|---|
| 4,976,545 | 12/1990 | Kipphan et al. . | |
| 5,010,817 | 4/1991 | Grosshauer . | |
| 5,020,432 | 6/1991 | Jeschke . | |
| 5,050,994 | 9/1991 | Kipphan | 101/147 x |
| 5,189,960 | 3/1993 | Valentini | 101/487 |

FOREIGN PATENT DOCUMENTS

| | | |
|---|---|---|
| 0323537 | 7/1989 | European Pat. Off. . |
| 0357987 | 3/1990 | European Pat. Off. . |
| 3732934 | 4/1989 | Germany . |
| 3904854 | 4/1990 | Germany . |
| 4000912 | 5/1991 | Germany . |
| 4-126251 | 4/1992 | Japan . |
| 57-192814 | 3/1995 | Japan . |

OTHER PUBLICATIONS

Deutscher Drucker Publication No. 17, May 6, 1993, "Der wasserlose Offsetdruck–Wechselwirkungen . . . ".

*Primary Examiner*—J. Reed Fisher

*Attorney, Agent, or Firm*—Herbert L. Lerner; Laurence A. Greenberg

[57] ABSTRACT

Method of controlling inking in a printing press, wherein the inking is evaluated in non-image areas during printing with a printing form on printing material, includes generating with at least one image-detecting device image signals in the non-image areas on the surface of the printing material, feeding the image signals to a control or regulating device and, with a temperature-controlling device, varying the temperature of ink applied to the printing form in accordance with the image signals.

1 Claim, 1 Drawing Sheet

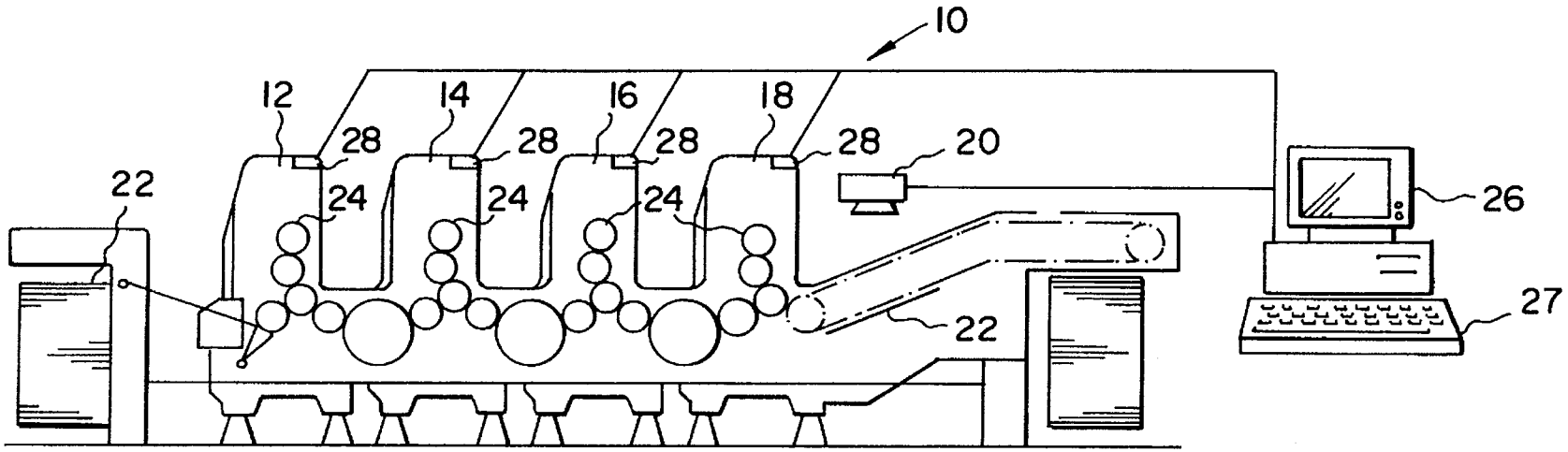
10
12
14
16
18
20
22
24
26
27
28

METHOD OF CONTROLLING INKING IN A PRINTING PRESS

BACKGROUND OF THE INVENTION

Field of the Invention

The invention relates to a method of controlling inking in a printing press by effecting specific adjustments in order to avoid scumming in the printed image.

In wet offset printing processes, a major cause of scumming is an improper proportion of the amount of dampening medium to the amount of ink applied on the printing form. If printing takes place with too little dampening medium, scumming appears in the form of tonal stripes or ink fogging or halo formation in the non-image areas of the respective printing material.

It has become known heretofore to detect these tonal stripes or the fogging optoelectronically by means of an image-detecting device directed onto the surface of the printing material. The image signals of non-image areas may be fed to a control device and used for automatically controlling the supply of the dampening medium (published European Patent Document EP 0 357 987 A1, U.S. Pat. No. 5,050,994).

Furthermore, scumming occurs especially if the temperature of the printing ink or the dampening medium is not at a certain level. In waterless offset printing, the temperature of the printing ink is especially critical (German magazine "Der Drucker", No. 17/May 6, 1993, pages W43–W44).

In order to control the influences of the temperature upon the printing ink, it has been known heretofore to provide conventional temperature-controlling devices for the dampening medium, as well as for the ink form rollers and the printing ink, respectively (published German Patent Documents DE 39 04 854 C1 and DE 40 00 912 C1).

The temperature-controlling device disclosed in the published German Patent Document DE 39 04 854 C1 is a temperature-detecting and controlling system, the function of which is to keep the temperature in the inking unit at a constant level as a function of reference data and temperature values detected in an inking unit and in the flow and return means of the temperature-controlling medium flowing through an inking roller. In each inking unit of a printing press, the reference temperature is predetermined, taking into account corrective values reflecting the properties of the dampening medium, the paper, the room temperature. the humidity in the room, and the properties of the ink. The temperature-controlling system includes a microprocessor, and the corrective values may be inputted therein via a keyboard.

A disadvantage of this procedure is that the reference temperature values and the corrective values are inputted manually and remain unchanged during the printing process. As a result thereof, the changes of the physical quantities influencing the printing process are not taken into account. For example, the room temperature, the humidity, the suction capacity of the printing material, the pH value of the dampening medium or the viscosity of the printing ink may vary, however, during the printing process. Due to the fixed corrective values, these variations would not be compensated for so that, in an extreme situation, scumming may occur, notwithstanding that the temperature of the ink form rollers is controlled.

SUMMARY OF THE INVENTION

It is an object of the invention to provide a method of controlling inking in a printing press by controlling or regulating ink temperature which optimally adapts itself to the varying method conditions.

With the foregoing and other objects in view, there is provided, in accordance with the invention, a method of controlling inking in a printing press, wherein the inking is evaluated in non-image areas during printing with a printing form on printing material, which comprises generating with at least one image-detecting device image signals in the non-image areas on the surface of the printing material, feeding the image signals to a control or regulating device and, with a temperature-controlling device, varying the temperature of ink applied to the printing form in accordance with the image signals.

Thus, the object of the invention is achieved in that, when printing on a printing material, the inking in a printing press is influenced by varying, by means of a temperature-controlling device, the temperature of the printing ink applied to the printing form, as a function of image signals obtained by an image-detecting device which is directed onto printing material and continuously generates image signals in non-image areas.

In this manner, the reference values for the ink temperature are constantly adapted to the varying method conditions so that each individual inking unit of a printing press functions optimally.

The non-image areas are constantly monitored with respect to tonal stripes or fogging. In the event tonal stripes or fogging occur, the temperature-controlling device reduces the temperature of the printing ink until the tonal stripes or the fogging disappear.

Other features which are considered as characteristic for the invention are set forth in the appended claims.

Although the invention is illustrated and described herein as a method of controlling inking in a printing press, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the single FIGURE of the drawing, in which there is shown diagrammatically an offset printing press suitably equipped for performing the method according to the invention.

DESCRIPTION OF THE PREFERRED EMBODIMENTS

In a waterless offset printing press 10 having several printing units, such as four printing units 12, 14, 16 and 18 in the illustrated embodiment, a conventional image-detecting device 20 which detects the entire surface of the printing material 22 is provided after the last printing unit in the travel direction of the printing material 22. The image-detecting device 20 is connected to a control and regulating device, such as a microcomputer 26 having a keyboard 27. Each of the inking units 12 to 18 of the printing press 10 is equipped with a respective conventional temperature-controlling device 28 by means of which the ink temperature may be controlled to a defined temperature level.

At the start of the printing process, the reference temperature of the printing ink is lower than the critical toning index temperature which is indicative of the beginning of a toning problem.

In the production-run condition, printing image signals obtained from non-image areas are fed to the control and regulating device 26. In the control or regulating device or microcomputer 26, the image signals are processed so that signals may be derived if toning occurs in the non-image areas. Based upon the derived signals, adjusting signals for the temperature-controlling devices 28 are generated so that the temperature of the ink is reduced until the tonal stripes or the ink fogging disappear. In the production run, scumming may thus be eliminated at an early stage from the entire printing job. The set temperature serves as a new reference value for the control of the temperature of the printing ink. Thus, the control and regulating device or microcomputer 26 inputs adjusting signals to the temperature-controlling devices 28 and receives actual-value signals from the latter. It functions in accordance with the state of the art as exemplified by several of the aforementioned references.

I claim:

1. Method of controlling inking in a printing press, which comprises the steps of evaluating the inking in non-image areas during printing with a printing form on printing material, generating with at least one image-detecting device image signals from the non-image areas on the surface of the printing material, feeding the image signals to a control or regulating device and, with a temperature-controlling device, varying the temperature of ink applied to the printing form in accordance with the image signals.

* * * * *